US006250184B1

(12) United States Patent
Chang

(10) Patent No.: US 6,250,184 B1
(45) Date of Patent: Jun. 26, 2001

(54) HAND TOOL HAVING A FAST REPLACEABLE BLADE

(76) Inventor: Jong-Shing Chang, No. 5, Chang Ma Street, Chang Ma Rd., Hsiu Shui Hsian, Changhua Hsien (TW)

( * ) Notice: Subject to any disclaimer, the term of this patent is extended or adjusted under 35 U.S.C. 154(b) by 0 days.

(21) Appl. No.: 09/468,841

(22) Filed: Dec. 22, 1999

(51) Int. Cl.[7] ..... B25B 7/02

(52) U.S. Cl. ..... 81/415; 81/418; 81/421; 81/422

(58) Field of Search ..... 81/415, 418, 421, 81/422, 423, 391

(56) References Cited

U.S. PATENT DOCUMENTS 5,113,727 * 5/1992 Foster .
6,047,426 * 4/2000 McIntosh et al. .
6,131,495 * 10/2000 Chen .

* cited by examiner

*Primary Examiner*—Timothy V. Eley
*Assistant Examiner*—Willie Berry, Jr.
(74) *Attorney, Agent, or Firm*—Browdy & Neimark

(57) ABSTRACT

A hand tool comprises at least one handle, at least one connection member, and at least one blade. The handle is provided with a pivoting portion having a receiving slot and a pivoting hole in which the connection member is located. The connection member is formed of a pin, a spring, a collar and a ring. The pin has a head, a cylindrical portion, a tangential plane, and a tail end. The head presses against the receiving slot. The cylindrical portion and the tangential plane are put through the pivoting hole and fitted into the spring and the collar. The blade has a working portion and a fastening portion which is provided with an open slot and a locating hole and is fastened with the connection member such that the cylindrical portion of the pin of the connection member is releasably located in the locating hole of the fastening portion of the blade, thereby enabling the fastening portion of the blade to disengage the pivoting portion of the handle by pressing the tail end of the pin of the connection member.

10 Claims, 8 Drawing Sheets

HAND TOOL HAVING A FAST REPLACEABLE BLADE

FIELD OF THE INVENTION

The present invention relates generally to a hand tool, and more particularly to a hand tool having a blade which can be replaced fast by blades of various functions.

BACKGROUND OF THE INVENTION

There are a variety of hand tools, such as wire stripper, open end wrench, ring wrench, pliers, etc. These conventional hand tools have a unitary body consisting of one or two handles, and a working part fixed with the handles. As a result, the consumer must purchase a variety of hand tools at additional cost. In addition, it is rather inconvenient for a worker to carry with him or her with a variety of hand tools at the work site.

SUMMARY OF THE INVENTION

It is the primary objective of the present invention to provide a hand tool having one or two handles capable being fastened with a variety of blades of various functions so as to reduce the cost of owning the hand tools.

It is another objective of the present invention to provide a hand tool having a cutting part which can be fast replaced with blades of various functions.

In keeping with the principle of the present invention, the foregoing objectives of the present invention are attained by a hand tool comprising at least one handle, at least one connection member, and a blade. The handle is provided at one end thereof with a pivoting portion which is provided with a receiving slot and a pivoting hole in which the connection member is disposed. The connection member is formed of a pin having a head, a cylindrical portion, a tangential plane, and a tail end. The head is located outside the receiving slot of the handle. The cylindrical portion and the tangential plane are put through the pivoting hole before being fitted into a coil spring and a collar. The tail end of the pin is provided with a C-shaped locating ring. The blade is provided at one end thereof with a working portion, and at other end thereof with a connection portion which is provided with an open slot and a locating hole for receiving the cylindrical portion of the connection member. As the pin is pressed to displace axially, the connection portion of the blade can be inserted into or taken out of the receiving slot of the handle.

DETAILED DESCRIPTION OF THE INVENTION

Figure 1:
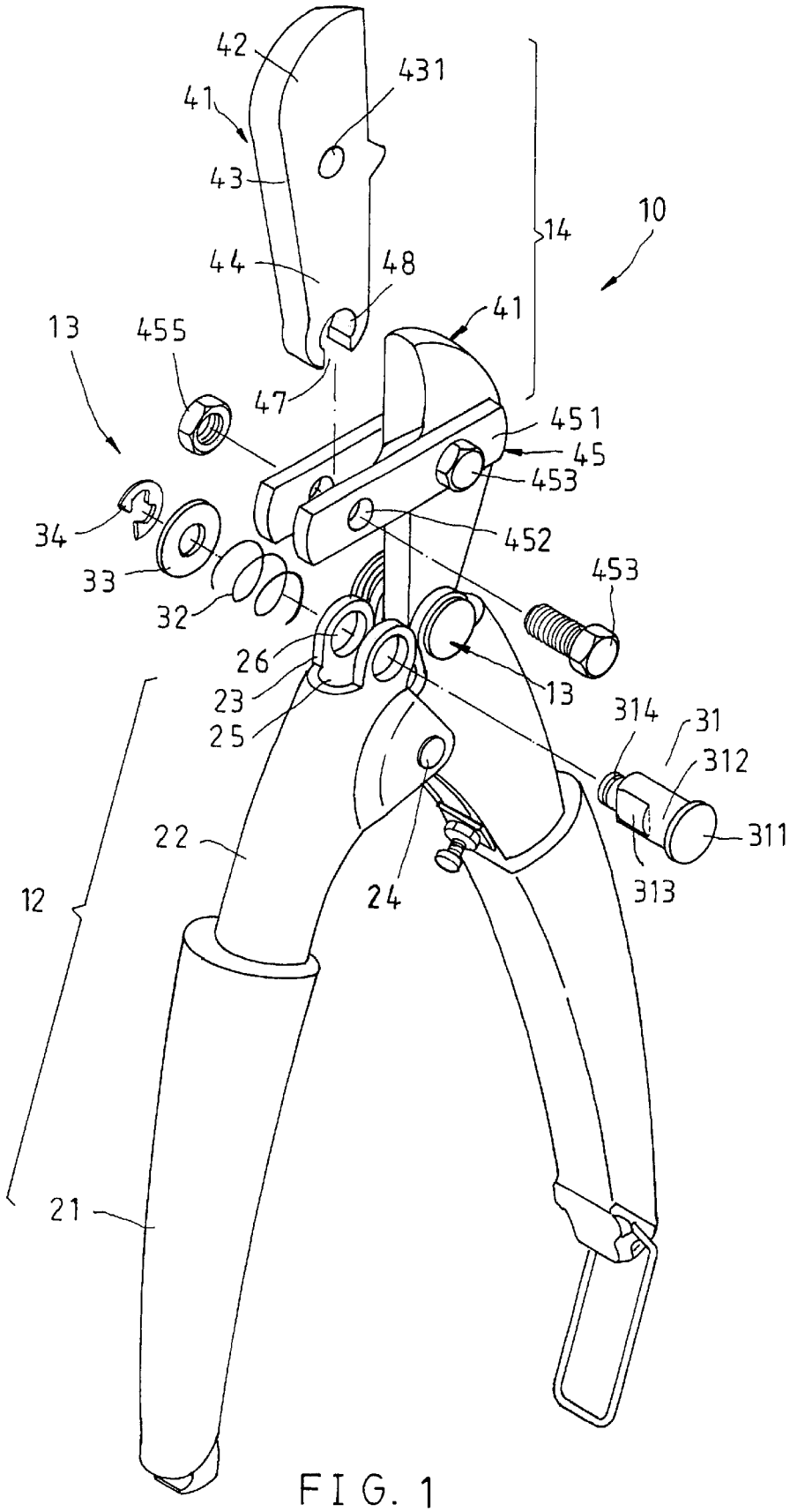
FIG. 1 shows a partial exploded view of a first preferred embodiment of the present invention.
Figure 2:
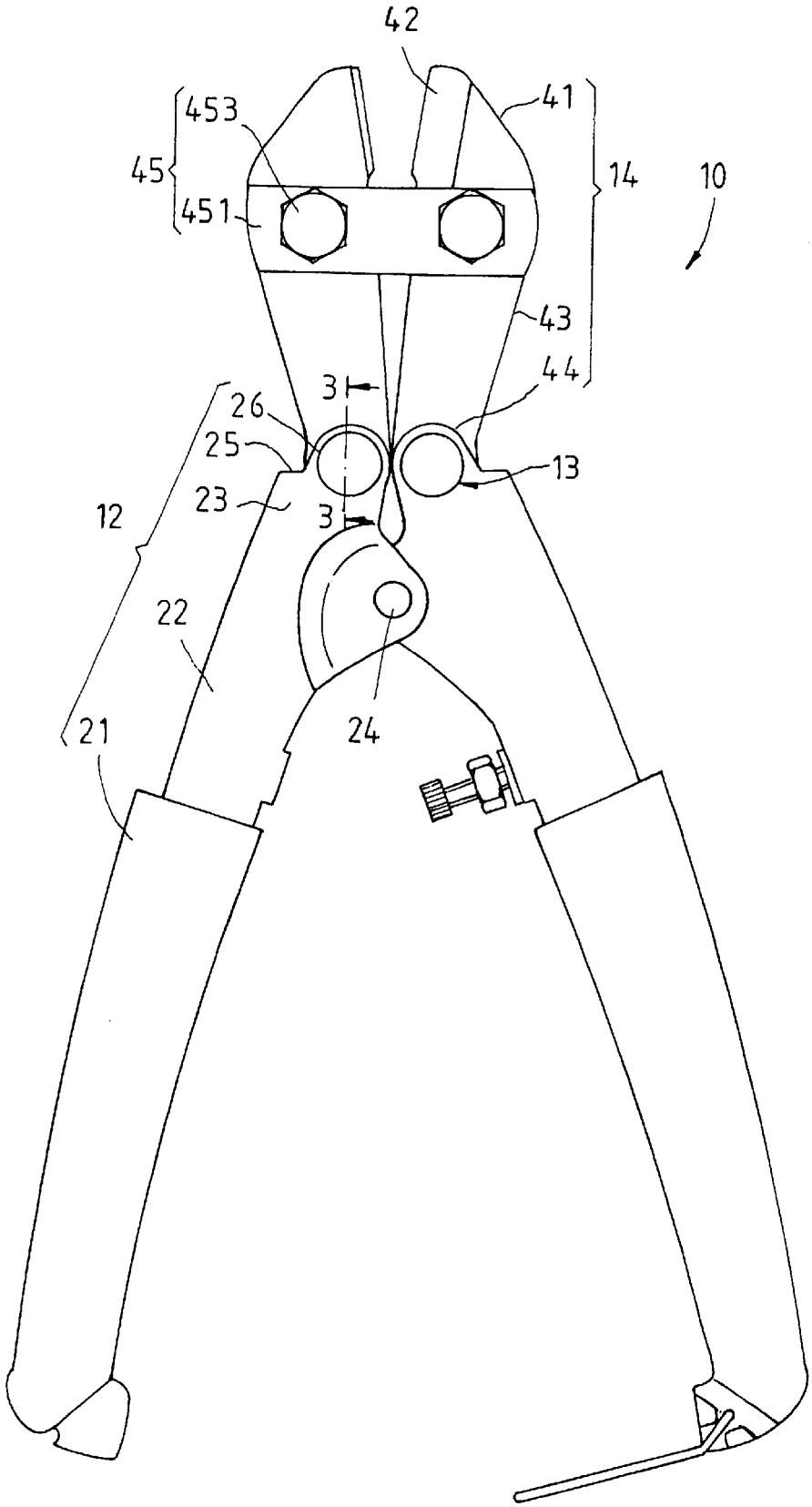
FIG. 2 shows a schematic plan view of the first preferred embodiment of the present invention in combination.

As shown in FIG. 1, a metal shears 10 of the first preferred embodiment of the present invention comprises two handles 12, two connection members 13, and a cutting part 14.

The handles 12 are sequentially provided with a grip portion 21, a midsegment 22, and a pivoting portion 23. The pivoting portion 23 is provided at one end thereof with an open slot 25 of an appropriate depth, a pivoting hole 26 in communication with the open slot 25, and a pivoting element 24 pivoting the midsegments 22 of the two handles 12. The two pivoting portions 23 of the two handles 12 work at the time when the grip portions 21 of the two handles 12 are applied with force.

Figure 3:
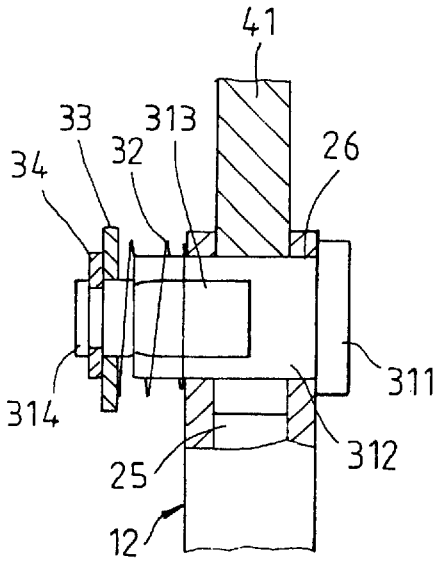
FIG. 3 shows a sectional view taken along the direction indicated by a line 3—3 as shown in FIG. 2.
Figure 4:
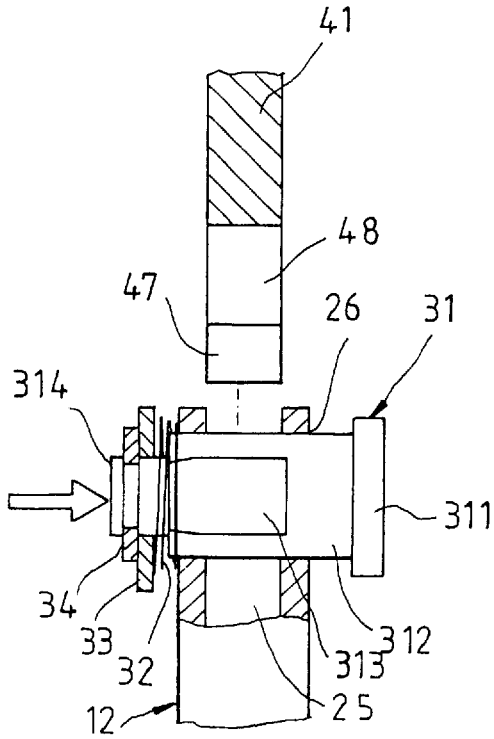
FIG. 4 shows a schematic view of the replacing of a blade of the preferred embodiment of the present invention.

The two connection members 13 are formed of a pin 31, a coil spring 32, a collar 33, and a C-shaped ring 34. The pin 31 has a diametrically expanded head 311, a cylindrical portion 312 next to the head 311, a tangential plane 313, and a diametrically reduced tail end 314. The cylindrical portion 312 has an outer diameter slightly smaller than the hole diameter of the pivoting hole 26. As a result, the cylindrical portion 312 is capable of an axial displacement in the pivoting hole 26. The pin 31 is received in the pivoting hole 26 of the handle 12 such that the head 311 presses against the outer edge of one side of the slot 25, and that the cylindrical portion 312 and the tangential plane 313 are put through the pivoting hole 26 before they are fitted into the coil spring 32 and the collar 33, and further that the tail end 314 is located by a C-shaped ring 34. The coil spring 32 urges at one end thereof the collar 33, and at other end thereof the outer edge of other side of the slot 25, as shown in FIG. 3.

The cutting part 14 is composed of two jaws 41, with each having a blade 42, a midsegment 43, a fastening portion 44, and a pivoting member 45. The midsegment 43 is provided with a round through hole 431. The pivoting member 45 is formed of two connection pieces 451, two bolts 453 and two nuts 455. The two jaws 41 are fastened pivotally by the two connection pieces 451 in conjunction with the bolts 453 which are received in the two round holes 452 of the connection pieces 451 and the two round holes 431 of the jaws 41. The fastening portion 44 is provided at one end thereof with an open slot 47 and a locating hole 48 in communication with the open slot 47. The locating hole 48 has a diameter which is corresponding to an outer diameter of the cylindrical portion 312 of the pin 31 of the connection member 13 and is greater than a width of the open slot 47, with the width of the open slot 47 being slightly greater than the tangential place 313 of the pin 31. The open slots 47 and the locating holes 48 serve as structures for pivoting the two jaws 41 with the two handles 12.

In operation, the tail end 314 of the pin 31 is pressed to compress the coil spring 32 so as to cause the tangential plane 313 to retreat into the open slot 25 of the handle 12.

Thereafter, the fastening portion 44 of the jaw 41 is inserted via the open slot 25 and in alignment with the tangential plane 313 of the pin 31. The pin 31 is then relieved of the application force such that the pin 31 is urged by the recovery force of the coil spring 32, thereby causing the cylindrical portion 312 to be located in the locating hole 48 of the jaw 41, as shown in FIG. 3. The jaws 41 are detached by pressing the tail end 314 of the pin 31 so as to cause the tangential plane 313 of the pin 31 to retreat into the slot 25 of the handle 12 to be in alignment with the open slot 44 of the jaw 41. In light of the diameter of the locating hole 48 of the jaw 41 and the width of the open slot 47 being greater than the width of the tangential plane 313 of the pin 31, the jaw 41 can be taken out of the slot 25 to become separated from the pin 31.

Figure 5:
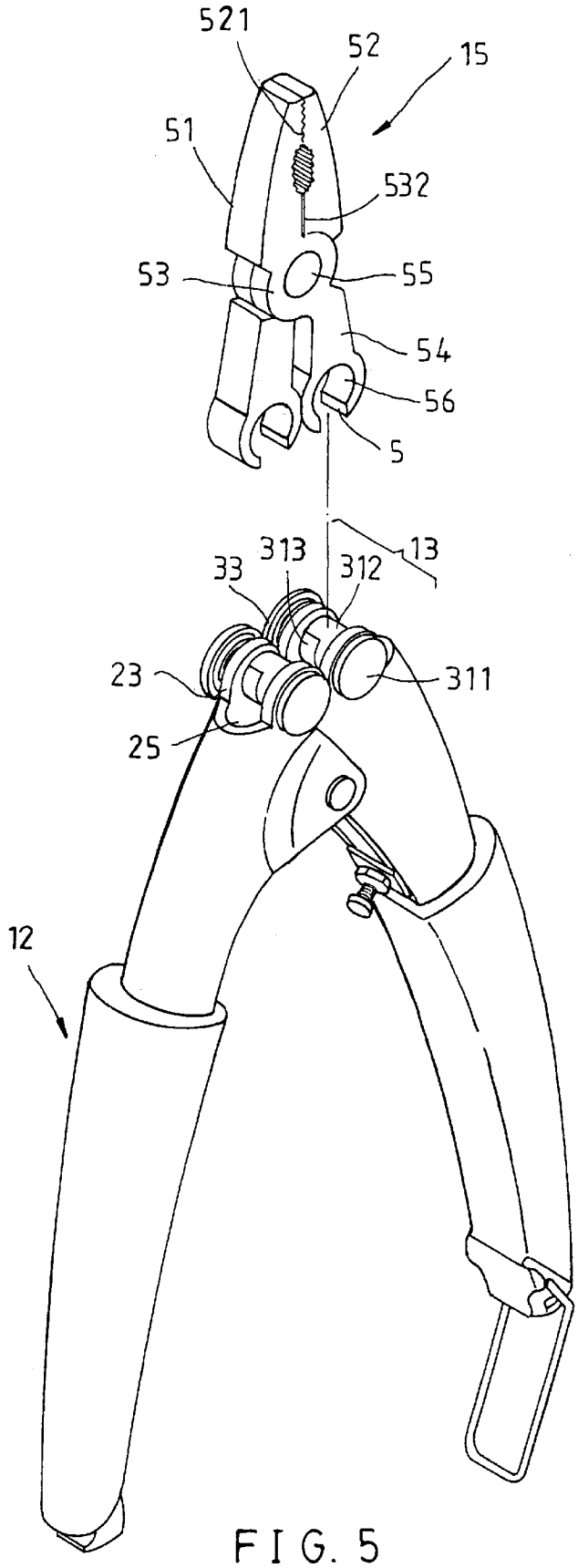
FIG. 5 shows a precombination view of a second preferred embodiment of the present invention
Figure 6:
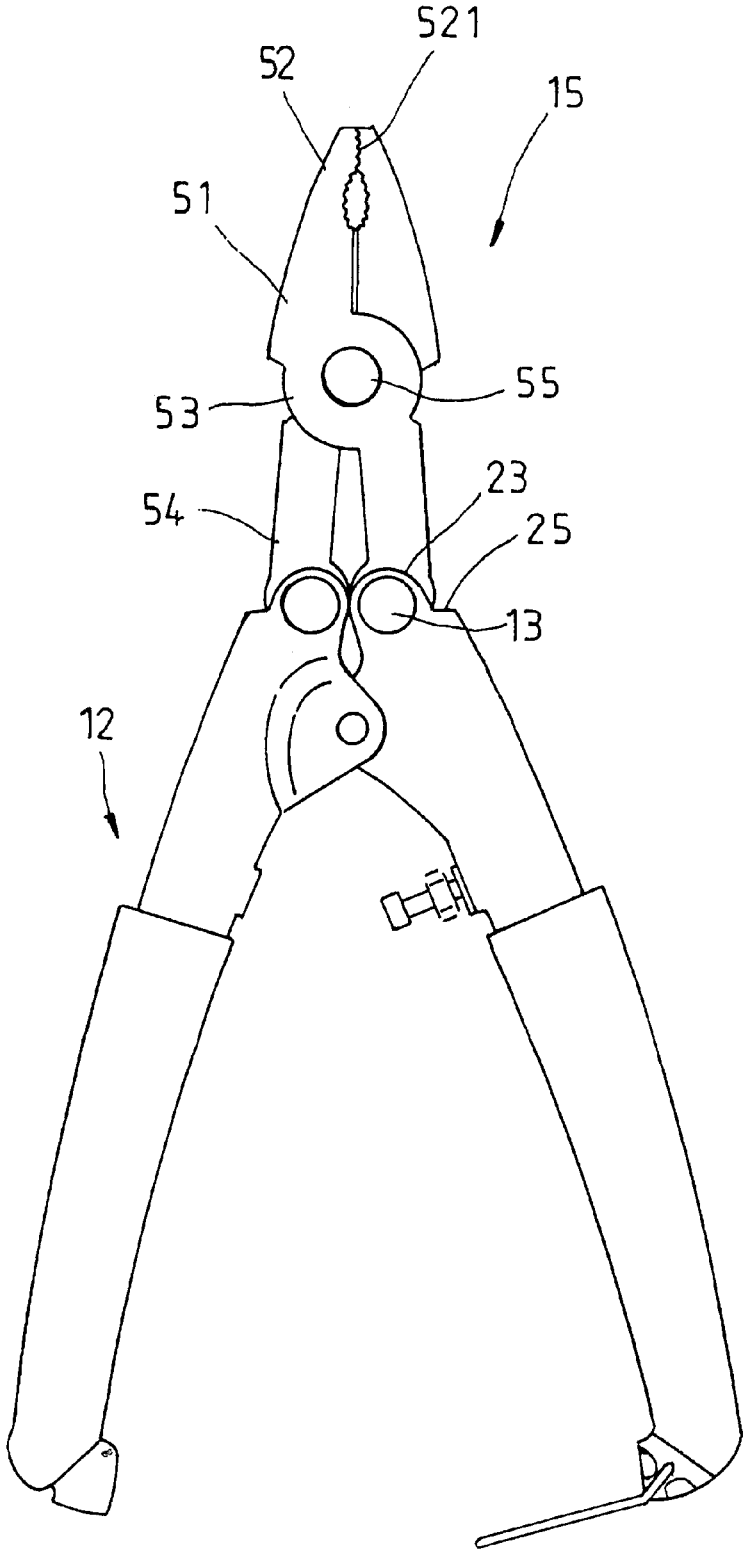
FIG. 6 shows a schematic plan view of the second preferred embodiment of the present invention in combination.

As shown in FIGS. 5 and 6, the second preferred embodiment of the present invention comprises two handles 12, two connection members 13, and a blade 15 of a needle-nose pliers.

The blade 15 is formed of two jaws 51, with each having a working portion 52, a midsegment 53, and a fastening portion 54. The midsegment 53 is provided with a round hole for receiving a pivoting member 55. The working portions 52 are provided with serrated portions 521 opposite to each other. The fastening portion 54 is provided with a locating hole 56 and an open slot 57, with the diameter of the locating hole 56 being corresponding to outer diameter of the cylindrical portion 312 of the pin 31 and being greater than the width of the open slot 57.

The tail end 314 of the pin 31 is pressed to cause the tangential plane 313 to retreat into the slot 25 of the handle 12. The jaw 51 is inserted such that the open slot 57 is in alignment with the tangential plane 313. The pin 31 is then relieved of the application force. The cylindrical portion 312 is located in the locating hole 56 of the jaw 51. The jaws 51 of the blade 15 are actuated by the handles 12. The working portions 52 may be constructed to work like a gardening shears or tree pruner.

Figure 7:
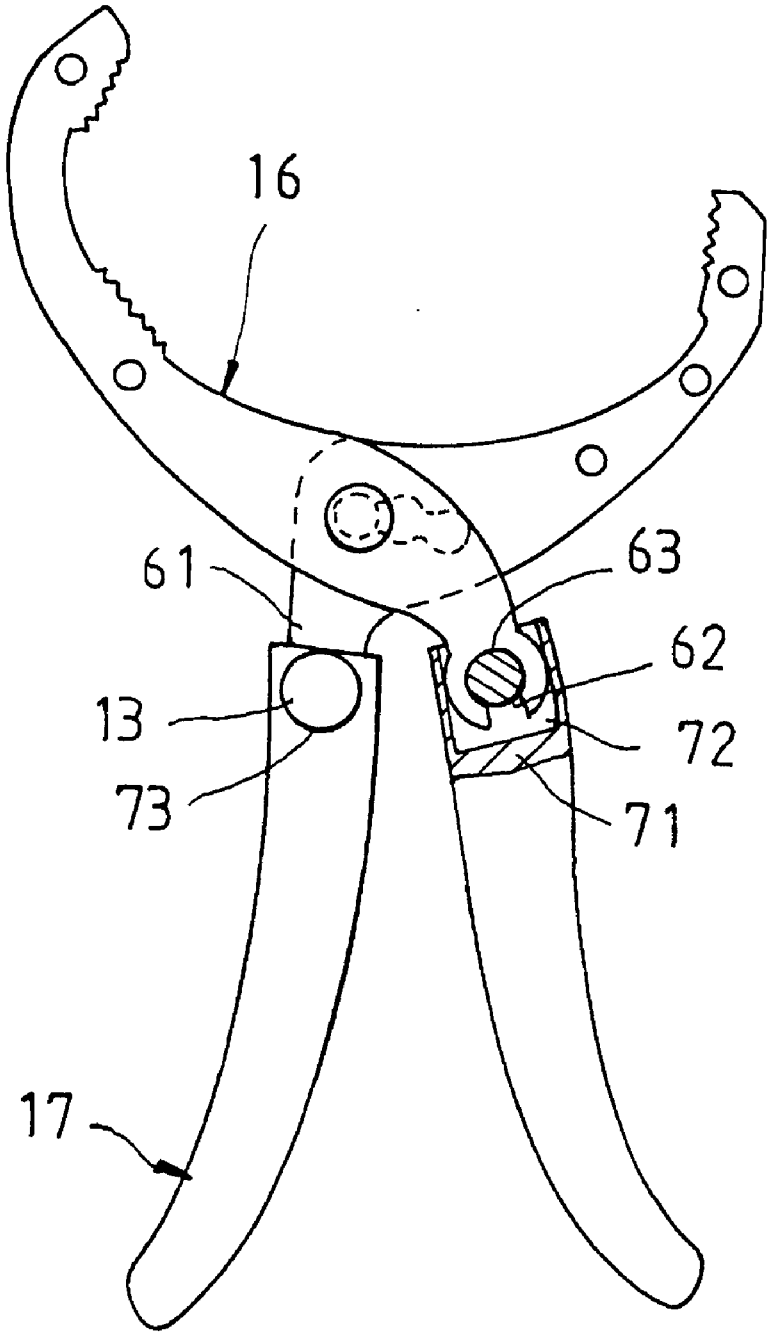
FIG. 7 shows a precombination view of a third preferred embodiment of the present invention.

As shown in FIG. 7, the third preferred embodiment of the present invention has a blade 16 which is intended for use as an oil can pliers. The blade 16 is provided in the lower segment thereof with a fastening portion 61 which has an open slot 62 and a locating hole 63. The handle 17 is provided in the upper segment thereof with a pivoting portion 71, a slot 72 and a pivoting hole 73 in which the connection member 13 is received. The blade 16 can be also replaced with ease and speed.

Figure 8:
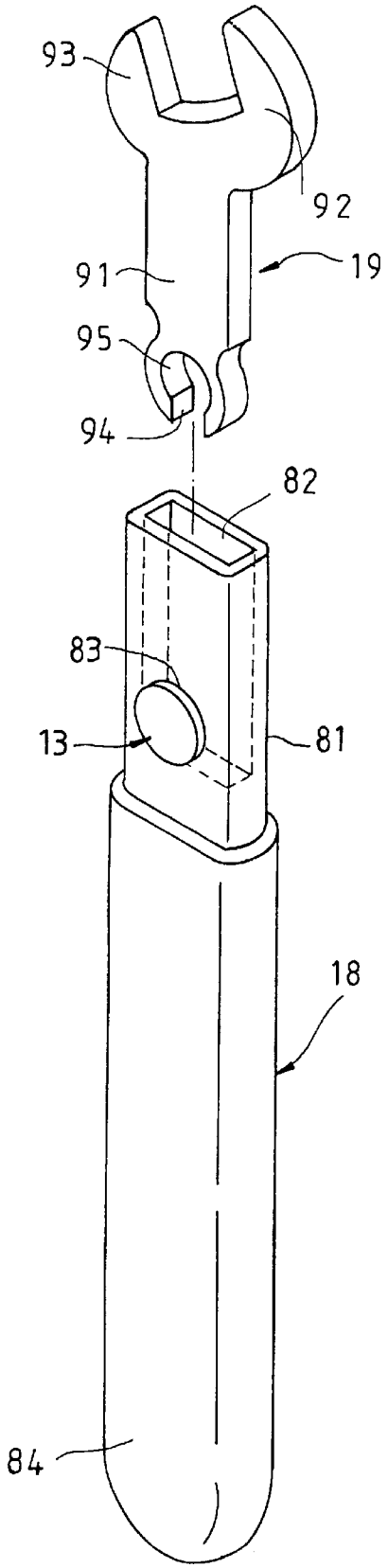
FIG. 8 shows a schematic plan view of the third preferred embodiment of the present invention in combination.
Figure 9:
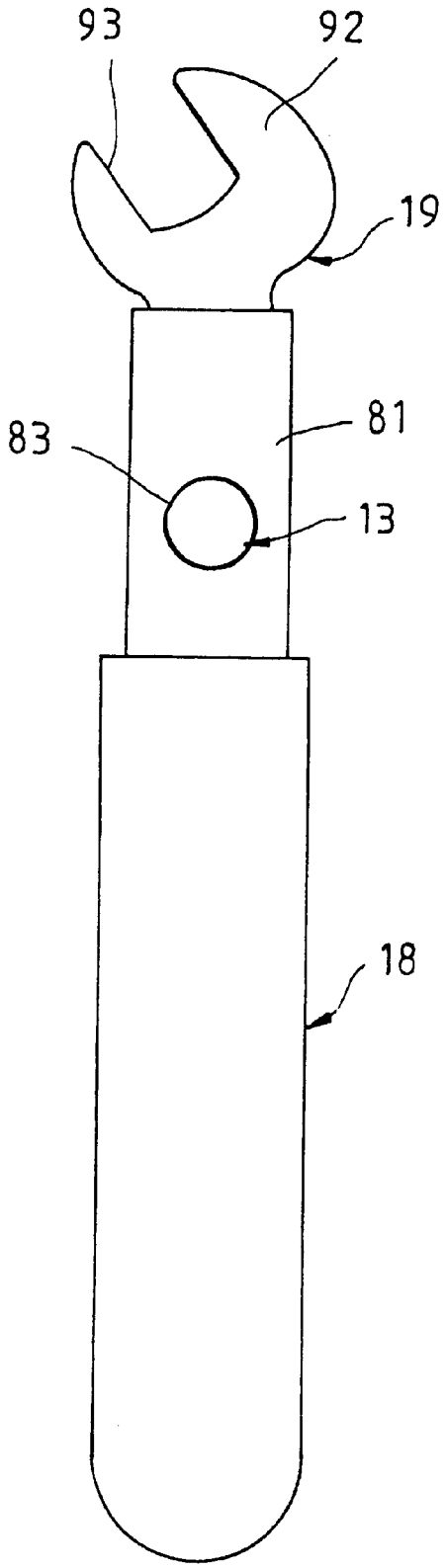
FIG. 9 shows a schematic plan view of a fourth preferred embodiment of the present invention in combination.

As shown in FIGS. 8 and 9, the fourth preferred embodiment of the present invention comprises only one handle 18, one connection member 13 and one blade 19. The handle 18 of the wrench is provided with a pivoting portion 81. The pivoting portion 81, the connection member 13 and the fastening portion 91 of the blade 19 are basically similar in construction to those of the first and the second preferred embodiments of the present invention, with the differences being that the slot 82 of the pivoting portion 81 of the handle 18 is deeper, and that the pivoting hole 83 is disposed in the slot 82 and is located away from the edge of the pivoting portion 81 for locating the connection member 13. In addition, the blade 19 is of a unitary construction and is provided with a working portion 92 having a C-shaped clamping hole 93 engageable with a bolt head or nut. The clamping hole 93 may be of a round construction.

The fastening portion 91 of the blade 19 is fastened with the connection member 13 located in the pivoting hole 83 of the handle 18 by means of the open slot 94 and the locating hole 95. The blade 19 can be fast replaced with another blade by pressing the tail end 311 of the pin 31 of the connection member 13. In operation, the pivoting point (the connection member 13) of the handle 18 and the blade 19 is located at the edge far away from the pivoting portion 81, the fastening portion 91 of the blade 19 is thus confined by the slot 82. As a result, the pin 31 of the connection member 13 is prevented from turning at the time when the blade 19 is at work.

The present invention is versatile in design, simple in construction, and cost-effective. The present invention is thus provided with a competitive edge over the conventional hand tools.

What is claimed is:

1. A hand tool comprising:

at least one handle provided at one end thereof with a grip portion, and at other end thereof with a pivoting portion having an open slot and a pivoting hole penetrating said slot;

at least one connection member formed of a pin, a coil spring, a collar, and a C-shaped ring, said pin having a head pressing against an outer side of said slot of said handle, said pin further having a cylindrical portion next to said head and having an outer diameter smaller than a hole diameter of said pivoting hole, said pin further having a tangential plane next to said cylindrical portion, said cylindrical portion and said tangential plane being fitted into said coil spring and said collar after being put through said pivoting hole, said pin further having a tail end next to said tangential plane for engaging said C-shaped ring to prevent said pin, said coil spring and said collar from being separated from said pivoting hole; and a blade provided at one end thereof with a working portion of a predetermined function, and at other end thereof with a fastening portion corresponding in number to said working portion, said fastening portion provided with an open slot and a locating hole having a diameter which is corresponding to an outer diameter of said cylindrical portion of said pin and is greater than a width of said open slot, with the width of said open slot being greater than said tangential plane of said pin;

said tail end of said pin of said connection member being pressed to enable said tangential plane to be located in said slot of said handle, thereby enabling said fastening portion of said blade to be inserted into or taken out of said slot of said handle such that said cylindrical portion of said pin is located in or moved out of said locating hole of said blade.

2. The hand tool as defined in claim 1, wherein said working portion of said blade is a C-shaped clamping hole.

3. The hand tool as defined in claim 2, wherein said slot of said handle has a depth; wherein said pivoting hole is located in an edge far away from said slot of said handle, thereby enabling said blade to be confined by said slot of said handle so as to prevent said pin from turning at the time when said blade is at work.

4. The hand tool as defined in claim 1, wherein said working portion of said blade is a clamping hole of a round construction.

5. The hand tool as defined in claim 1, wherein said blade is formed of two jaws which are pivoted together by a pivoting member and are provided at one segment thereof with a working portion and at other segment thereof with a fastening portion which is in turn provided with an open slot and a locating hole in communication with said open slot whereby said fastening portion is fastened with two connection members located in said pivoting holes of said pivoting portions of said two handles.

6. The hand tool as defined in claim 5, wherein said two jaws are provided in a midsegment thereof with a round through hole for receiving a pivoting member of a pivot whereby said pivoting member serves as a pivoting point on which said two working portions of said two jaws turn.

7. The hand tool as defined in claim 5, wherein said two jaws are provided in a midsegment thereof with a round through hole; wherein said pivoting member is formed of two connection pieces, two bolts, and nuts, with said two connection pieces being disposed in a front side and a rear side of said two jaws, said bolts being received in said through holes of said jaws and through holes of said connection pieces such that said bolts are engaged with said nuts whereby said two connection pieces are linked with said working portions of said two jaws.

8. The hand tool as defined in claim 5, wherein said two jaws of said blade are pivoted by a pivoting element which is put through the midsegments of said two handles.

9. The hand tool as defined in claim 5, wherein said two working portions of said two jaws are provided with serrated portions opposite to each other.

10. The hand tool as defined in claim 5, wherein said two working portions of said two jaws are provided with cutting edges opposite to each other.

* * * * *